US011273960B2

(12) United States Patent
Sahara et al.

(10) Patent No.: US 11,273,960 B2
(45) Date of Patent: Mar. 15, 2022

(54) HINGED CAP

(71) Applicant: Nippon Closures Co., Ltd., Tokyo (JP)

(72) Inventors: Toru Sahara, Tokyo (JP); Yuji Takayama, Tokyo (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 95 days.

(21) Appl. No.: 16/597,114

(22) Filed: Oct. 9, 2019

(65) Prior Publication Data

US 2020/0039702 A1 Feb. 6, 2020

Related U.S. Application Data

(63) Continuation of application No. PCT/JP2018/014985, filed on Apr. 10, 2018.

(30) Foreign Application Priority Data

Apr. 13, 2017 (JP) ..... JP2017-079552

(51) Int. Cl.
*B65D 47/08* (2006.01)
*B65D 47/40* (2006.01)

(52) U.S. Cl.
CPC ..... *B65D 47/08* (2013.01); *B65D 47/40* (2013.01); *B65D 47/0804* (2013.01)

(58) Field of Classification Search
CPC .... B65D 47/40; B65D 47/08; B65D 47/0804; B65D 2251/1041
(Continued)

(56) References Cited

U.S. PATENT DOCUMENTS 3,179,290 A 4/1965 Whitney
2015/0360831 A1* 12/2015 Backert ..... B65D 23/06 222/109

FOREIGN PATENT DOCUMENTS

JP 3-15362 U 2/1991
JP 4-109050 U 9/1992
(Continued)

OTHER PUBLICATIONS

International Search Report dated Jun. 5, 2018, issued in counterpart International Application No. PCT/JP2018/014985 (1 page).
(Continued)

*Primary Examiner* — Rafael A Ortiz
*Assistant Examiner* — Sanjidul Islam
(74) *Attorney, Agent, or Firm* — Westerman, Hattori, Daniels & Adrian, LLP

(57) ABSTRACT

To provide a hinged cap is capable of preventing liquid content from squirting out and minimizing adhesion of the content on the top face of the cap or around an outer circumferential abutment part, with a simple structure. A hinged cap (100) includes a cap body (110) and an upper lid (130) connected by a hinge (150), with a tubular spout wall (112) provided on an upper surface side of the cap body (110), and a circular suspended part (132) provided on an upper lid top face (131). The circular suspended part (132) has an outer circumferential abutment part (133) that makes contact with an inner circumferential surface of the tubular spout wall (112). The hinged cap includes a liquid build-up prevention part (134) at least in a lower part of the circular suspended part (132) opposite to a part connected to the hinge.

3 Claims, 5 Drawing Sheets

(58) Field of Classification Search
USPC ..... 215/235
See application file for complete search history.

(56) References Cited

FOREIGN PATENT DOCUMENTS

| | | | | | |
|---|---|---|---|---|---|
| JP | 9-290853 | A | | 11/1997 | |
| JP | 09290853 | A | * | 11/1997 | |
| JP | 2012096809 | A | * | 5/2012 | |
| JP | 5657999 | B2 | | 1/2015 | |
| WO | WO-2006042813 | A2 | * | 4/2006 | ..... B65D 47/40 |

OTHER PUBLICATIONS

Extended (Supplementary) European Search Report dated Jan. 12, 2021, issued in counterpart EP Application No. 18784938.5. (8 pages).

* cited by examiner

HINGED CAP

TECHNICAL FIELD

The present invention relates to a hinged cap to be fitted to a container opening to allow a dispensing passage of the content held inside the container to be opened and closed by movements of an upper lid.

BACKGROUND ART

Hinged caps having a cap body to be mounted to a container opening and an upper lid connected to the cap body by a hinge are conventionally used in various applications as caps of various containers filled with, for example, seasonings. The hinged cap includes a cap body with a top plate part and a tubular side wall extending downward from a peripheral edge of the top plate part for receiving the container opening fixed inside thereof, and an upper lid connected to the cap body by a hinge, the upper lid having an upper lid top face and a skirt part extending downward from a peripheral edge of the upper lid top face and being configured to open from and close on the cap body.

Such a hinged cap is opened and closed by a movement of the upper lid. When the upper lid is closed, the interior of the hinged cap sealed by the closed upper lid including the inner side of the upper lid is kept in communication with the container interior so that, when the container is stored on its side after it has been used, for example, the liquid content may adhere on the inner side of the upper lid.

When the upper lid is opened for use again with the liquid content adhered on the inner side of the upper lid, the liquid content may scatter or drip as the upper lid is yanked open. A hinged cap (dispenser cap 1) configured to prevent these problems has been known from Patent Literature 1 and others, the hinged cap (dispenser cap 1) including a cap body (3) having a tubular spout wall (spout tube 15), and an upper lid (lid member 5) having a circular suspended part (seal tube 24) that forms an outer circumferential abutment part (seal part S) making contact all around with an inner circumferential surface of the tubular spout wall (spout tube 15) and a skirt part (annular side wall 26) surrounding the circular suspended part (seal tube 24) both extending downward from an upper lid top face (top wall 23). The tubular spout wall (spout tube 15) is flared out from the upper end of the abutment point contacting the outer circumferential abutment part (seal part S) to the distal end. A circumferential groove (28) and a liquid pocket (30) connecting to the circumferential groove (28) are formed respectively to the tubular spout wall (spout tube 15) and the circular suspended part (seal tube 24). The outer circumferential surface of the circular suspended part (seal tube 24), and an annular surface on the backside of the upper lid top face (top wall 23) between the circular suspended part (seal tube 24) and the skirt part (annular side wall 26) are formed as a mirror surface, while the inner circumferential surface of the skirt part (annular side wall 26) is textured.

In this hinged cap (dispenser cap 1), the tubular spout wall (spout tube 15) is flared out from the upper end of the abutment point contacting the outer circumferential abutment part (seal part S) to the distal end, and a circumferential groove (28) and a liquid pocket (30) connecting to the circumferential groove (28) are formed respectively to the tubular spout wall (spout tube 15) and the circular suspended part (seal tube 24), so that, when, after dispensing the liquid content, the upper lid (lid member 5) is closed before the liquid content adhered to the tip of the tubular spout wall (spout tube 15) has not returned completely into the container, the liquid content adhered to the tip of the tubular spout wall (spout tube 15) travels along the circumferential groove (28) formed between the outer circumferential surface of the circular suspended part (seal tube 24) and the inner circumferential surface of the tubular spout wall (spout tube 15) and accumulates in the liquid pocket (30). When the upper lid (lid member 5) is opened again, the liquid content that has accumulated in the liquid pocket (30) can drop down along the inner side face of the tubular spout wall (spout tube 15) and return into the container.

Since the outer circumferential surface of the circular suspended part (seal tube 24), and an annular surface on the backside of the upper lid top face (top wall 23) between the circular suspended part (seal tube 24) and the skirt part (annular side wall 26) are formed as a mirror surface, the liquid content adhered to the outer circumferential surface of the circular suspended part (seal tube 24) and the annular surface of the upper lid top face (top wall 23) can be quickly collected into the liquid pocket 30.

Moreover, with the inner circumferential surface of the skirt part (annular side wall 26) being textured, the liquid content adhered to the inner circumferential surface of the skirt part (annular side wall 26) can be held and stopped from dripping out of the hinged cap (dispenser cap 1).

CITATION LIST

Patent Literature

Patent Literature 1: Japanese Patent No. 5657999

SUMMARY OF INVENTION

Technical Problem

The hinged cap of Patent Literature 1, however, still had some scope of improvement. Namely, even with the liquid pocket 30 that holds liquid content after the upper lid (lid member 5) has been closed before the liquid content that adhered to the tip of the tubular spout wall (spout tube 15) when it was dispensed has not returned completely into the container, the liquid content might come out of the liquid pocket 30 when the container was stored on its side or shaken.

Furthermore, as the upper lid (lid member 5) was repeatedly opened and closed and every time the liquid content was dispensed, the liquid content that had adhered to the foot of the circular suspended part (seal tube 24) on the upper lid top face (top wall 23) inside the circular suspended part (seal tube 24) of the upper lid (lid member 5), or between the tip of the circular suspended part (seal tube 24) and the tubular spout wall, could gradually build up by the surface tension and might be squirted out when the upper lid (lid member 5) was yanked open.

When there is a sufficiently airtight seal formed between the skirt part (annular side wall 26) and the cap body (3), opening the upper lid (lid member 5) creates suction by the temporary expansion of the spatial volume between skirt part (annular side wall 26) and the circular suspended part (seal tube 24) when the upper lid (lid member 5) is opened, because of which the liquid content might be sucked out of the outer circumferential abutment part (seal part S) where the seal had begun breaking and squirted out.

Another problem in the embodiment described in Patent Literature 1 was that the outer circumferential abutment part (seal tube S) extends down longer toward the hinge (7) side so that the liquid pocket (30) and the circular suspended part (seal tube 24) tended to interfere with each other when the upper lid (lid member 5) was being closed, making it harder for the hinged cap (dispenser cap 1) to be closed.

The present invention solves these problems, its object being to provide a hinged cap that allows easy opening and closing of an upper lid and is capable of preventing liquid content from squirting out and minimizing adhesion of the content on the upper lid top face inside a circular suspended part of the upper lid or around an outer circumferential abutment part, with a simple structure.

Solution to Problem

The present invention provides a hinged cap including: a cap body having a top plate part and a tubular side wall extending downward from a peripheral edge of the top plate part to receive a container opening fixedly fitted inside the tubular side wall; and an upper lid connected to the cap body by a hinge and including an upper lid top face and a skirt extending downward from a peripheral edge of the upper lid top face, the upper lid being configured to open from and close on the cap body, the top plate part including a tubular spout wall protruding from an upper side of the top plate part, the upper lid top face including a circular suspended part protruding from an underside of the upper lid top face, the circular suspended part including an outer circumferential abutment part that makes contact with an inner circumferential surface of the tubular spout wall when the upper lid is closed on the cap body, and the circular suspended part including a liquid build-up prevention part at least in a lower part on an opposite side to a part connected to the hinge, whereby the problems noted above are solved.

Advantageous Effects of Invention

According to the hinged cap set forth in claim 1, the upper lid top face includes a circular suspended part protruding therefrom, and the circular suspended part includes an outer circumferential abutment part that makes contact with an inner circumferential surface of the tubular spout wall when the upper lid is closed on the cap body, and a liquid build-up prevention part at least in a lower part of the circular suspended part on an opposite side to a part connected to the hinge. Any clearance that may allow liquid content adhered around the tip of the circular suspended part to build up can be eliminated, so that accumulation of liquid content that may cause splashes can be minimized.

According to the hinged cap set forth in claim 2, the liquid build-up prevention part is an inclined end face extending from a lower end of an outer circumferential surface of the circular suspended part toward a center axis thereof and toward the upper lid top face. Any clearance that may allow liquid content adhered around the tip of the circular suspended part to build up can be eliminated, so that accumulation of liquid content that may cause splashes can be minimized more reliably.

According to the hinged cap set forth in claim 3, the circular suspended part is formed with a fitting guide in a lower part thereof near the part connected to the hinge. This reduces the resistance caused by the contact between the circular suspended part and the tubular spout wall on the hinge side when the upper lid is closed, so that the hinged cap can be closed easily.

According to the hinged cap set forth in claim 4, the fitting guide includes a guide end face extending from a lower end of an outer circumferential surface of the circular suspended part toward a center axis thereof and away from the upper lid top face. When the upper lid is closed, the circular suspended part is guided along the guide end face toward the inner circumferential side of the tubular spout wall even if the tip of the circular suspended part and the upper end of the tubular spout wall interfere with each other on the hinge side, so that the hinged cap can be closed reliably.

According to the hinged cap set forth in claim 5, the inclined end face and the guide end face are connected by a transforming end face that is formed such as to change shape gradually. The transition in the end face shape is thus smoother as compared to when the inclined end face and the guide end face are connected directly, which reduces the resistance when the circular suspended part contacts the tubular spout wall as the upper lid is closed, as well as enables a reduction in cost in terms of metal mold production and molding processes.

According to the hinged cap set forth in claim 6, a textured part is formed at least partly in surfaces of the tubular spout wall, the circular suspended part, and the upper lid top face, of a space formed when the upper lid is closed on the cap body and connecting to the container opening. Even if the liquid content adheres to the foot of the circular suspended part on the upper lid top face inside the circular suspended part of the upper lid, or around the tip of the circular suspended part, the textured part can retain the liquid content and prevents the liquid content from accumulating in one point.

REFERENCE SIGNS LIST

Figure 1:
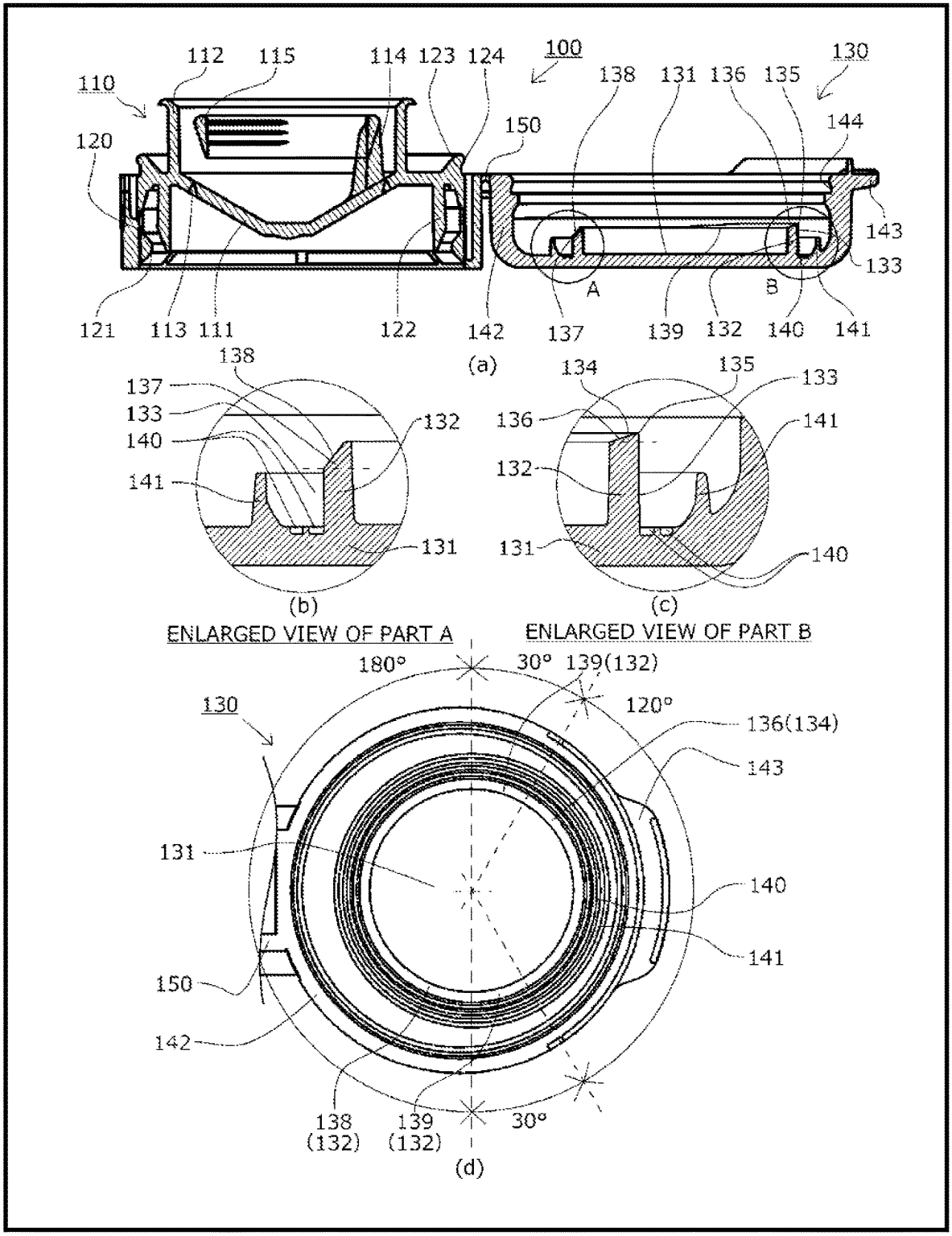
FIG. 1 shows a cross-sectional view of a hinged cap 100 according to one embodiment of the present invention with an upper lid 130 open, a top plan view illustrating how the inner surface of the upper lid 130 is formed, and enlarged views of the vicinity of a circular suspended part 132.

100 Hinged cap
110 Cap body
111 Top plate part
112 Tubular spout wall
113 Endless score line
114 Strut
115 Pull ring
120 Tubular side wall
121 Engagement protrusion

122 Inner ring fitted with the container
123 Circumferential projection
124 Convex section
130 Upper lid
131 Upper lid top face
132 Circular suspended part
133 Outer circumferential abutment part
134 Liquid build-up prevention part
135 Abutment edge
136 Inclined end face
137 Fitting guide
138 Guide end face
139 Transforming end face
140 Retention groove
141 Outer ring
142 Skirt part
143 Opening tab
144 Recess
150 Hinge
L Liquid content

DESCRIPTION OF EMBODIMENTS

A hinged cap 100 according to one embodiment of the present invention will be hereinafter described with reference to the drawings.

Figure 2:
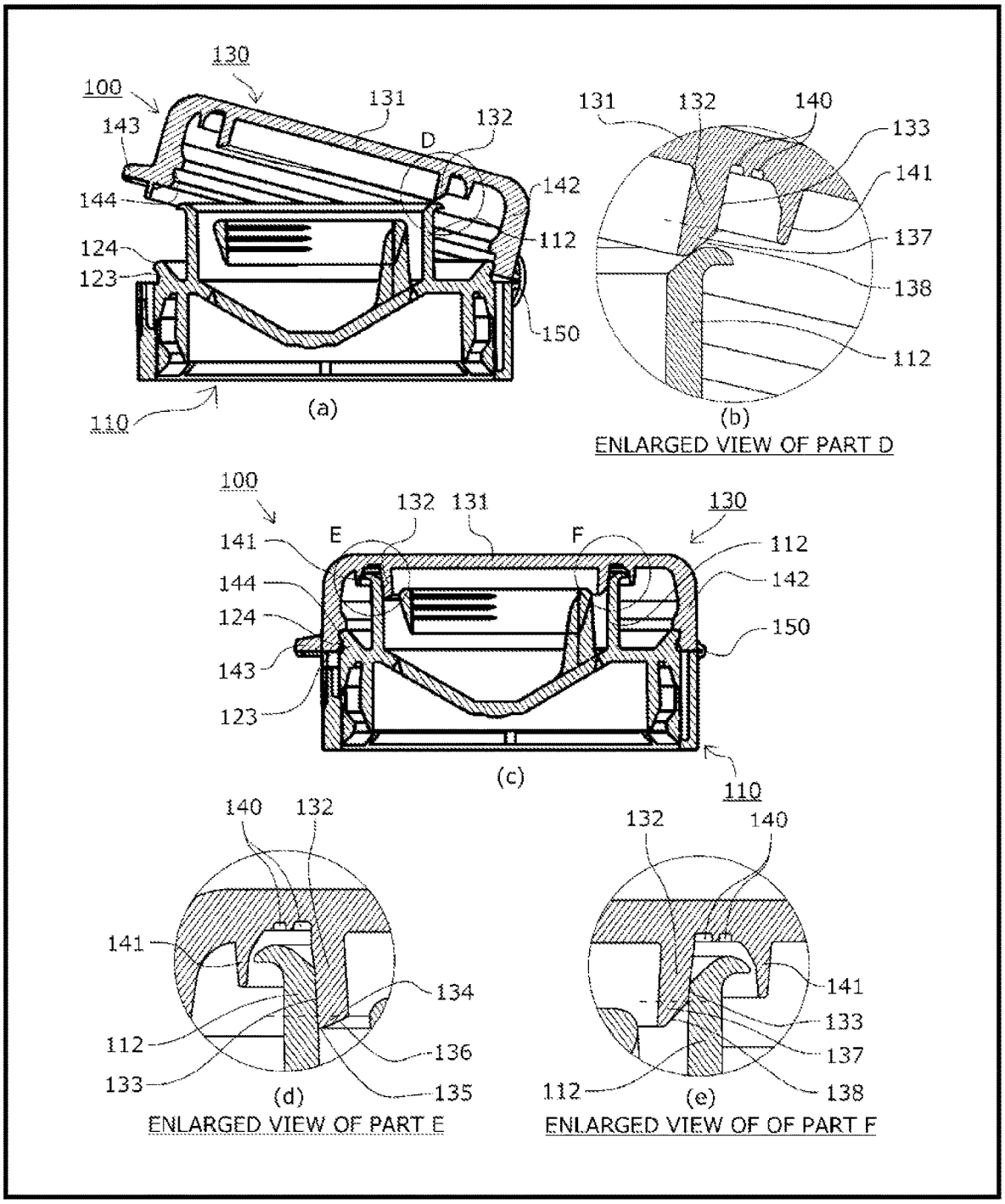
FIG. 2 shows cross-sectional views and enlarged views of the hinged cap 100 according to one embodiment of the present invention, with the upper lid 130 being nearly closed, and with the upper lid 130 being closed.

The hinged cap 100 is mounted to a container opening (not shown), and can open and close the dispensing passage of liquid content L held inside the container by movements of an upper lid 130. As shown in FIG. 1 and FIG. 2, the hinged cap includes a cap body 110, having a top plate part 111 and a tubular side wall 120 extending downward from a peripheral edge of the top plate part 111 for receiving the container opening (not shown) fixedly fitted inside the tubular side wall 120, and an upper lid 130 connected to the cap body 110 by a hinge 150.

The top plate part 111 of the cap body 110 is formed with a tubular spout wall 112 protruding from the upper side of the top plate part 111. The upper end of this tubular spout wall 112 is flared out to improve the dripless feature as well as to allow smooth discharge of liquid.

The top plate part 111 is provided with an endless score line 113 in the form of a thinned groove inside the tubular spout wall 112. A strut 114 protrudes upward from radially inside of the endless score line 113.

A pull ring 115 is connected to the upper end of the strut 114 such as to be positioned above the endless score line 113. Pulling this pull ring 115 breaks the endless score line 113 so that an opening for pouring out the liquid content L is formed in the top plate part 111.

On the underside of the top plate part 111 is formed an inner ring 122 extending downward to fit with the container.

An engagement protrusion 121 is formed on the inner side of the tubular side wall 120. When the container opening (not shown) is fitted between the inner ring 122 and the engagement protrusion 121, the engagement protrusion 121 engages with an outer surface of the container opening (not shown), so that the cap body 110 is fixedly fitted to the container opening (not shown).

A circumferential projection 123 is formed at the top of the tubular side wall 120, and a radially outwardly extending convex section 124 is formed in an upper part of the circumferential projection 123.

The upper lid 130 includes an upper lid top face 131 and a skirt part 142 extending downward from a peripheral edge of the upper lid top face 131. A lower end portion of the skirt part 142 is adapted to open from and close on the cap body 110. An opening tab 143 used for opening the upper lid 130 from the cap body 110 is formed on the radially outer side of the skirt part 142 opposite to the part connected to the hinge 150.

A recess 144 is provided in a lower part on the inner side of the skirt part 142.

A ring-like circular suspended part 132 protrudes from one side of the upper lid top face 131 that comes opposite the top plate part 111 when the upper lid 130 is closed on the cap body 110. The circular suspended part 132 has an outer circumferential abutment part 133 that makes contact with an inner circumferential surface of the tubular spout wall 112 when the upper lid 130 is closed on the cap body 110.

As shown in FIG. 1(*b*) and FIG. 1(*c*), an outer ring 141 is formed between the circular suspended part 132 and the skirt part 142 extending downward from the upper lid top face 131, and retention grooves 140 are formed between the circular suspended part 132 and the outer ring 141 such as to surround the circular suspended part 132.

The outer circumferential abutment part 133 of the circular suspended part 132 is configured to make circumferential and continuous contact with the inner circumferential surface of the tubular spout wall 112. A liquid build-up prevention part 134 is provided in a lower part of the circular suspended part 132 in a range of an arc defined by rotating an extension line from the center axis of the circular suspended part 132 to the opening tab 143, 60° each clockwise and counterclockwise.

The liquid build-up prevention part 134 has an abutment edge 135 and an inclined end face 136. The abutment edge 135 is formed in an arc at the lowermost end of the liquid build-up prevention part 134 and configured to make continuous contact with the tubular spout wall 112.

The inclined end face 136 extends from the abutment edge 135 toward the center axis of the circular suspended part 132 and toward the upper lid top face 131, and forms the lower end face of the liquid build-up prevention part 134.

This prevents any clearance where the liquid content L may build up from being created between the tubular spout wall 112 and the liquid build-up prevention part 134 when the upper lid 130 is closed.

The range of the liquid build-up prevention part 134 is preferably a range of an arc defined by rotating the extension line from the center axis of the circular suspended part 132 to the opening tab 143, 30° to 70° each clockwise and counterclockwise.

Instead of providing the inclined end face 136 to the liquid build-up prevention part 134, its lowermost end face may be formed by extending the abutment edge 135 horizontally, so that the liquid build-up prevention part 134 is square.

Figure 5:
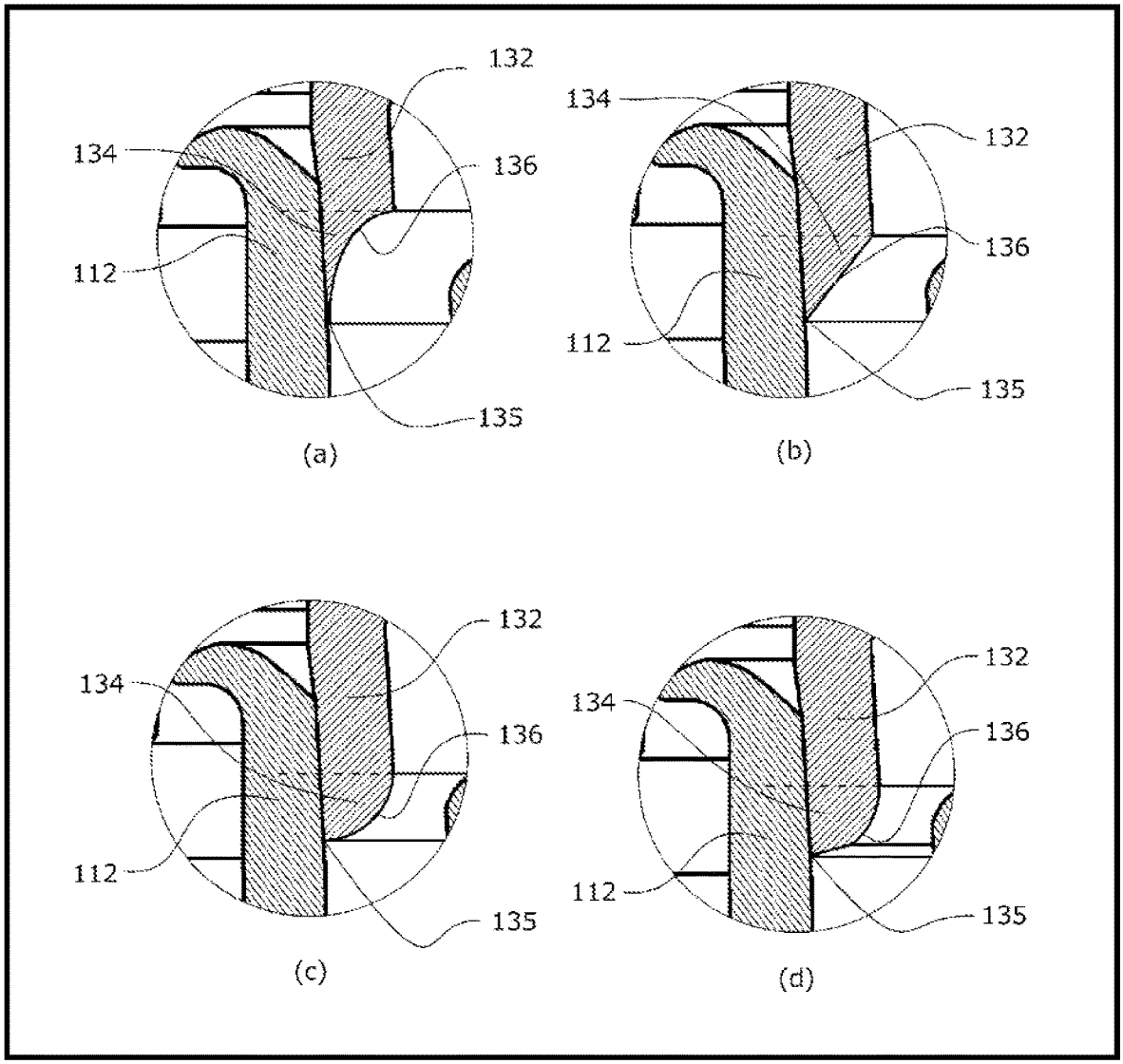
FIG. 5 shows cross-sectional views of the hinged cap 100 according to one embodiment of the present invention, illustrating alternative forms of the inclined end face 136.

The shape of the inclined end face 136 may be other than that of this embodiment, for example, as shown in FIG. 5(*a*) to FIG. 5(*c*), i.e., a concavely curved surface, straight line, a convexly curved surface and so on. As long as the inclined end face 136 extends from the abutment edge 135 toward the center axis of the circular suspended part 132 and is slanted gradually toward the upper lid top face 131, the abutment edge 135 may extend horizontally first, or, as shown in FIG. 5(*d*), may be made up of a combination of different shapes such as a straight line and a convexly curved surface.

Further, a fitting guide 137 configured to make contact with an inner circumferential surface of the tubular spout wall 112 is formed in a range of an arc defined by rotating the extension line from the center axis of the circular suspended part 132 to the part connected to the hinge 150, 90° each clockwise and counterclockwise, as shown in FIG. 1(*d*). The lower end face of the fitting guide 137 is formed as a guide end face 138 extending from the lower end of the outer circumferential surface of the circular suspended part 132 toward the center axis and away from the upper lid top face 131.

The fitting guide 137 is preferably formed in a range of an arc defined by rotating the extension line from the center axis of the circular suspended part 132 to the part connected to the hinge 150, 60° to 90° each clockwise and counter-clockwise.

When the upper lid 130 is closed, the guide end face 138 of the fitting guide 137 guides the circular suspended part 132 toward the inner circumference of the tubular spout wall 112 as shown in FIG. 2(*b*) so that the outer circumferential abutment part 133 of the circular suspended part 132 on the hinge 150 side makes contact with the inner circumferential surface of the tubular spout wall 112.

Even when the circular suspended part 132 on the opening tab 143 side is subjected to a force causing it to flex toward the opening tab 143, the circular suspended part 132 on the hinge 150 side has already been guided toward the inner circumferential side of the outer circumferential abutment part 133, so that the circular suspended part 132 is not caught on the tip of the tubular spout wall 112 and can smoothly fit therewith all around.

The inclined end face 136 and the guide end face 138 are connected via a transforming end face 139 that gradually changes its shape.

When the upper lid 130 of this hinged cap 100 is closed, the convex section 124 on the circumferential projection 123 engages with the recess 144 of the skirt part 142 as shown in FIG. 2(*c*), whereby the cap body 110 and the upper lid 130 are fixedly fitted to each other.

In this state, the tip of the tubular spout wall 112 snugly fits between the circular suspended part 132 and the outer ring 141, so that the inner circumferential surface of the tubular spout wall 112 makes tight contact with the outer circumferential abutment part 133 of the circular suspended part 132 having the abutment edge 135 at the lower end.

A lower part of the tubular spout wall 112 below the point contacting the inclined end face 136, the inner surface of the upper lid top face 131 inside of the circular suspended part 132, the inner circumferential surface of the circular suspended part 132, the inclined end face 136, the guide end face 138, and the transforming end face 139 have an arithmetic average of the roughness profile Ra of 3.0 to 15 μm provided by a surface treatment.

Next, the movement of liquid content L adhered inside the hinged cap 100 according to the hinged cap 100 of this embodiment during the dispensing process of the liquid content L will be explained with reference to FIG. 3 and FIG. 4.

First, the closed upper lid 130 is opened up, the pull ring 115 is pulled up to break the endless score line 113 so that an opening is formed in the top plate part 111. Next, the container is tipped or otherwise to pour out a necessary amount of liquid content L along the tubular spout wall 112 on the opposite side to the part connected to the hinge 150, after which the upper lid 130 is shut.

At this time, a small amount of liquid content L is adhered on an area from an inner circumferential surface to the flared distal end of the tubular spout wall 112, and as the upper lid 130 is closed, the liquid content L may be left between the circular suspended part 132 and the outer ring 141, and on the inner surface of a space formed by the cap body 110 and the upper lid 130 and connected to the opening in the top plate part 111.

The liquid content L does not remain in an amount that causes leaking or dripping after one dispensing process, but may build up after repeated dispensing processes or storage wherein the container is laid on its side with the upper lid 130 closed.

When there is a clearance at the foot of the circular suspended part 132, of a conventional shape in particular, on the upper lid top face 131 inside the circular suspended part 132 of the upper lid 130, or between the circular suspended part 132 and the tubular spout wall 112, the liquid content L may accumulate there by the surface tension and be squirted out when the upper lid 130 is yanked open. The circular suspended part 132 of the hinged cap 100 of this embodiment, as shown in FIG. 3(*b*), has a liquid build-up prevention part 134, with the abutment edge 135 and inclined end face 136, in a lower part on the side of the opening tab 143, so that there can be no clearance around the tip of the circular suspended part 132 on the side of the opening tab 143 large enough to allow liquid content L to accumulate and thus no liquid content L remains in an amount that will cause dripping or leaking.

The liquid content L that has adhered to the tip of the tubular spout wall 112 is enclosed inside the space surrounded by the circular suspended part 132 and the outer ring 141 when the upper lid 130 is closed, and during storage of the container on its side, the liquid gathers in the retention grooves 140. Since the liquid can stay inside the retention grooves 140 by the surface tension, the liquid content L does not squirt out of the retention grooves 140 when the upper lid 130 is opened.

When a sufficiently airtight seal is formed between the skirt part 142 and the cap body 110 by the engagement between the convex section 124 on the circumferential projection 123 and the recess 144 of the skirt part 142, opening the upper lid 130 creates suction by the temporary expansion of the spatial volume between the skirt part 142 and the circular suspended part 132, resulting in a force sucking out the liquid content L from the gap between the tubular spout wall 112 and the outer circumferential abutment part 133. However, the liquid content L is sucked out only in a slight amount because the airtight seal between the tubular spout wall 112 and the outer circumferential abutment part 133 is first broken in the region tightly enclosed by the tubular spout wall 112 and the liquid build-up prevention part 134 with the inclined end face 136 when the upper lid 130 is opened. Therefore no squirting of the liquid content L occurs.

Figure 3:
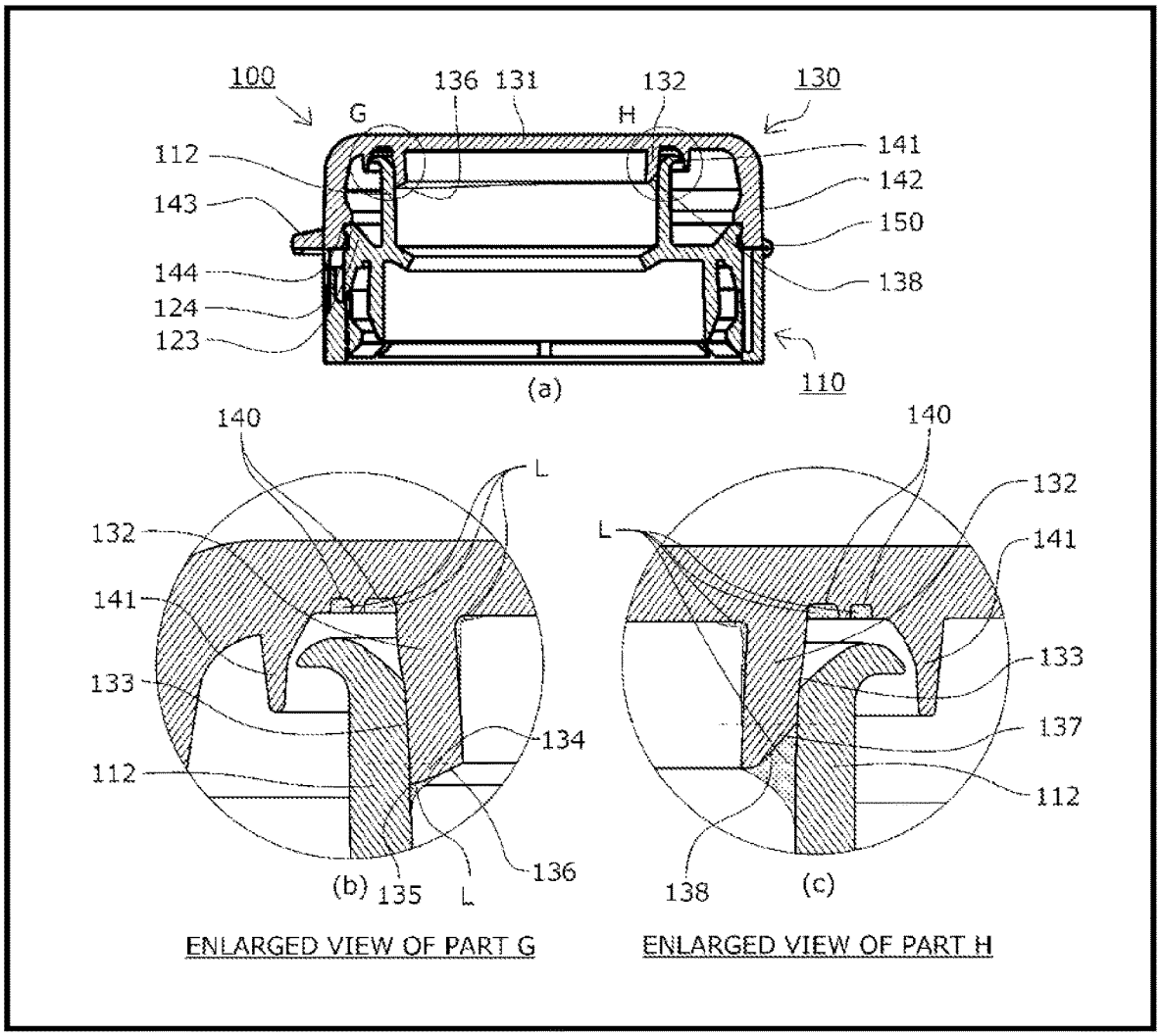
FIG. 3 shows a cross-sectional view of the hinged cap 100 according to one embodiment of the present invention in a state after the liquid content L has been dispensed and stored, with the upper lid 130 closed, and enlarged views of the vicinity of the circular suspended part 132.
Figure 4:
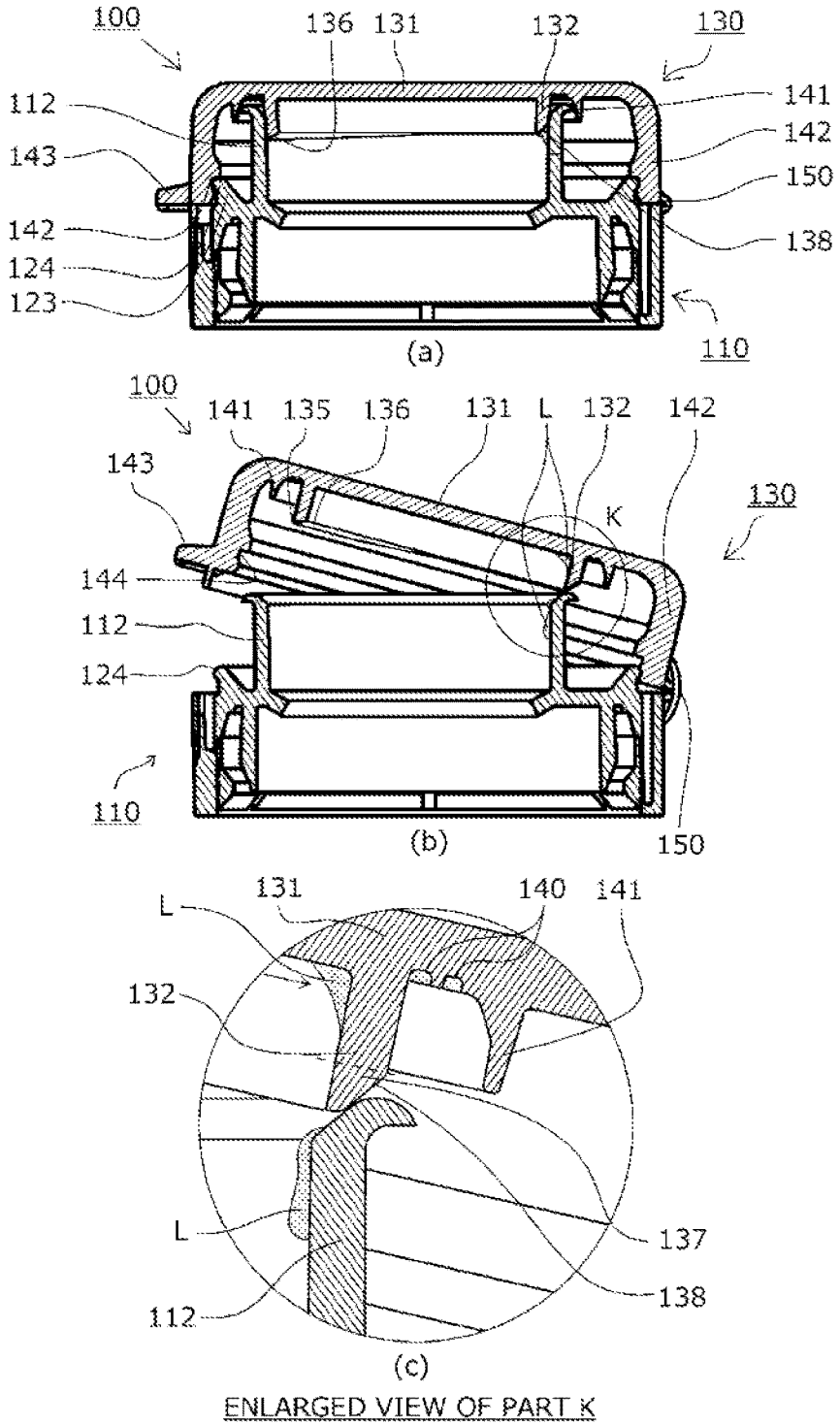
FIG. 4 shows cross-sectional views and an enlarged view of the hinged cap 100 according to one embodiment of the present invention, illustrating the movement of the liquid content L adhered to the inner surface of the hinged cap 100, when the upper lid 130 is opened after the liquid content L has been dispensed and the upper lid 130 has been closed.

A large clearance is formed near the tip of the circular suspended part 132 on the hinge 150 side between the tubular spout wall 112 and the guide end face 138 and the liquid content L accumulates there as shown in FIG. 3(*c*). As mentioned above, however, when the upper lid 130 is opened, the airtight seal is first broken in the region tightly enclosed by the tubular spout wall 112 and the liquid build-up prevention part 134 with the inclined end face 136, so that, by the time the circular suspended part 132 on the hinge 150 side separates from the tubular spout wall 112, the pressure there is at the atmospheric level, and therefore no squirting of the liquid content L occurs.

Moreover, the lower part of the tubular spout wall 112 below the point contacting the abutment edge 135, the inner surface of the upper lid top face 131 inside of the circular suspended part 132, the inner circumferential surface of the circular suspended part 132, the inclined end face 136, the guide end face 138, and the transforming end face 139 have a rough surface provided by a surface treatment. Therefore, any liquid content L remaining on the inner surface of the space formed by the cap body 110 and the upper lid 130 and connected to the opening in the top plate part 111 is distributed and held on the textured parts so that there is no point where the liquid content L gathers, and thus squirting of the liquid content L when the upper lid 130 is opened is prevented.

While one embodiment of the present invention has been described in detail above, the present invention is not limited to the embodiment described above, and various design changes are possible without departing from the scope of the present invention set forth in the claims.

In the embodiment described above, the outer circumferential abutment part of the circular suspended part is configured to make circumferential and continuous contact with the inner circumferential surface of the tubular spout wall, and the liquid build-up prevention part having the abutment edge and inclined end face is provided in a lower part of the circular suspended part in a range of an arc defined by rotating an extension line from the center axis of the circular suspended part to the opening tab 60° each clockwise and counterclockwise. The structure of the liquid build-up prevention part is not limited to this, and it may be formed to extend all around in the lower part of the circular suspended part.

In the embodiment described above, a fitting guide configured to make contact with an inner circumferential surface of the tubular spout wall is formed in a range of an arc defined by rotating the extension line from the center axis of the circular suspended part to the part connected to the hinge 90° each clockwise and counterclockwise, with a guide end face extending from the fitting guide toward the center axis of the circular suspended part and away from the upper lid top face. The form of the fitting guide and guide end face is not limited to this, and the guide end face need not necessarily be provided, for example.

In the embodiment described above, the inclined end face and the guide end face are connected by a transforming end face formed such as to change shape gradually. The form of the transforming end face is not limited to this. For example, the inclined end face may extend from the lower end of the outer circumferential abutment part toward the center axis of the circular suspended part and toward the upper lid top face in an area of an arc defined by rotating an extension line from the center axis of the circular suspended part to the opening tab 60° each clockwise and counterclockwise, and both ends of the inclined end face may be connected by a transforming end face without the guide end face, or, there may be no transforming end face.

In the embodiment described above, the lower part of the tubular spout wall below the point contacting the outer circumferential abutment part, the inner surface of the upper lid top face inside of the circular suspended part, the inner circumferential surface of the circular suspended part, the inclined end face, the guide end face, and the transforming end face have a textured surface provided by a surface treatment. The areas provided with a textured surface are not limited to these. For example, the inclined end face only may be provided with a textured surface, or, the entire surface of the hinged cap except for the abutting parts of the circular suspended part and the tubular spout wall may be provided with a textured surface.

In the embodiment described above, an airtight seal is provided between the skirt part and the cap body by the engagement between the protrusion on the circumferential projection and the recess of the skirt part. The relationship between the skirt part and the cap body is not limited to this. For example, the protrusion may be formed on the circumferential projection only on the side of the opening tab, so that the skirt part and the cap body engage with each other without forming an airtight seal.

In the embodiment described above, a ring-like circular suspended part is provided to the upper lid top face, on the side that faces the top plate part when the upper lid is closed on the cap body, such as to protrude from the upper lid top face, the circular suspended part having an outer circumferential abutment part that makes contact with the inner circumferential surface of the tubular spout wall when the upper lid is closed on the cap body. The form of the circular suspended part is not limited to this, and it may be formed as a solid column, for example.

The invention claimed is:

1. A hinged cap comprising: a cap body including a top plate part and a tubular side wall extending downward from a peripheral edge of the top plate part to receive a container opening fixedly fitted inside the tubular side wall; and an upper lid connected to the cap body by a hinge and including an upper lid top face and a skirt part extending downward from a peripheral edge of the upper lid top face, the upper lid being configured to open from and close on the cap body, the top plate part including a tubular spout wall protruding from an upper surface side of the top plate part, the upper lid top face including a circular suspended part protruding from a lower surface side of the upper lid top face, the circular suspended part including an outer circumferential abutment part that makes contact with an inner circumferential surface of the tubular spout wall when the upper lid is closed on the cap body, and the circular suspended part including a liquid build-up prevention part at least in a lower part on an opposite side to a part connected to the hinge, the liquid build-up prevention part being an inclined end face extending from a lower end of an outer circumferential surface of the circular suspended part toward a center axis thereof and toward the upper lid top face, the circular suspended part being formed with a fitting guide in the lower part thereof near the part connected to the hinge, the fitting guide including a guide end face extending from the lower end of the outer circumferential surface of the circular suspended part toward the center axis thereof and away from the upper lid top face, the inclined end face and the guide end face being connected by a transforming end face that is formed so as to change shape gradually, the upper lid is fitted to the cap body, the lower end of the circular suspended part is located above a lower end of the tubular spout wall, the lower end of the circular suspended part on the inner circumferential surface is formed to have a uniform length from the upper lid top face, and the fitting guide is formed in a range of an arc defined by rotating an extension line from the center axis of the circular suspended part to the part connected to the hinge, 60° to 90° each clockwise and counterclockwise.

2. The hinged cap according to claim 1, wherein the fitting guide is formed in a range of an arc defined by rotating an extension line from the center axis of the circular suspended part to the part connected to the hinge, 90° each clockwise and counterclockwise.

3. The hinged cap according to claim 1, wherein a textured part is formed at least partly in surfaces of the tubular spout wall, the circular suspended part, and the upper lid top face, of a space formed when the upper lid is closed on the cap body and connecting to the container opening.

* * * * *